US006328076B1

(12) United States Patent
Speich

(10) Patent No.: US 6,328,076 B1
(45) Date of Patent: Dec. 11, 2001

(54) THREAD CONTROLLING DEVICE WITH CONTROL ELEMENT SUPPORTED INDEPENDENTLY FROM THE LIFTING DEVICE

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/508,139

(22) PCT Filed: Jul. 8, 1998

(86) PCT No.: PCT/CH98/00334

§ 371 Date: Mar. 7, 2000

§ 102(e) Date: Mar. 7, 2000

(87) PCT Pub. No.: WO99/13145

PCT Pub. Date: Mar. 18, 1999

(30) Foreign Application Priority Data

Sep. 8, 1997 (DE) ..... 297 16 100

(51) Int. Cl.[7] ..... D03C 13/00

(52) U.S. Cl. ..... 139/55.1; 139/54; 139/455; 139/59

(58) Field of Search ..... 139/50, 48, 54, 139/55.1, 455, 59

(56) References Cited

U.S. PATENT DOCUMENTS

| | | | | |
|---|---|---|---|---|
| 4,671,327 | * | 1/2000 | Klocker | 139/54 |
| 5,261,464 | | 11/1993 | Lorenzo et al. | 139/93 |
| 6,009,917 | * | 1/2000 | Meyns et al. | 139/54 |
| 6,041,831 | * | 3/2000 | Kuoni et al. | 139/55.1 |

FOREIGN PATENT DOCUMENTS

| | | |
|---|---|---|
| 0 108 700 | 5/1984 | (EP) . |
| 0 536 092 | 4/1993 | (EP) . |
| 97/11215 | 3/1997 | (WO) . |

* cited by examiner

*Primary Examiner*—Andy Falik
(74) *Attorney, Agent, or Firm*—McCormick, Paulding & Huber LLP

(57) ABSTRACT

A thread controlling assembly containing an oscillating operable lifting device with at least one carrier for a warped thread of a weaving machine, and a control element which can be actuated using an actuator in order to selectively bring the thread in contact with the carrier. The control element is supported independently of the lifting device. Additionally, the control element need only be moved by an incremental switching amplitude for guiding the thread into and out of the carriers.

28 Claims, 18 Drawing Sheets

THREAD CONTROLLING DEVICE WITH CONTROL ELEMENT SUPPORTED INDEPENDENTLY FROM THE LIFTING DEVICE

BACKGROUND OF THE INVENTION

I. Technical field

The invention relates in general, to a thread control device for selectively controlling an oscillating transverse movement of a thread, in particular a warped thread of a weaving machine, having at least one lifting device which can be driven in an oscillating fashion, a carrier for a thread and at least one control means which can be actuated to bring the thread selectively into engagement with the carrier.

II. Background Information

There are many known thread control devices, particularly in shedding mechanisms, for optionally controlling an oscillating transverse movement of a thread.

In a first type of such thread control devices, the threads are controlled indirectly, the thread being moved only when it is selected. For this purpose, threads are firmly drawn into eyelets of healds and guided, the healds being moved in a programmed fashion via connecting means with the aid of upstream jacquard machines, heald looms and treading machines. It is easy to establish in this case that selective movement of the thread requires a multiplicity of components and a large stroke for them, and this necessarily has a very negative influence in many regards. Thus, in particular, the speed of the shedding mechanism is very limited because of the high mass forces. Further marked disadvantages of the known thread control devices are, for example, a high wear level, strong vibration, loud noise, a large space requirement because of the complicated devices, and poor ergonomics and the like. Finally, they are also relatively expensive, because of the complicated design.

A second type of such thread control devices is disclosed in U.S. patent application Ser. No. 09/043,542 filed Mar. 19, 1998. This thread control device has a lifting device, which can be driven in an oscillating fashion, having at least one carrier for the thread, as well as at least one control means which can be actuated by means of an actuator in order to bring the thread selectively into engagement with the carrier of the lifting device. These control means are arranged, assigned directly to the carrier, on the lifting device and are moved to go up and down with the latter. This results in various disadvantages. Since the lifting device must contain not only the carrier but, in particular, also the control means and the actuator, it has a relatively large volume. This thread control device is ill-suited to a weaving machine with a high warp count. Moreover, the moving parts are of relatively large mass and must, in addition, be moved over the entire stroke of the lifting device. The co-movement of the actuator further requires a moving interface with the supply of power and program data, which is relatively complicated, expensive and prone to wear. A thread has to be drawn in very carefully, in order to prevent parts from being bent, and thus a functional failure associated with corresponding repair costs. Despite good accessibility, it is time consuming and costly to draw in a thread. Finally, because of the relatively high mass forces and the sensitivity of the electronic system integrated into the moving parts, such a thread control device can be operated only at a relatively low speed.

DISCLOSURE OF THE INVENTION

SUMMARY OF THE INVENTION

It is the object of the invention further to provide an improved thread control device.

The object set is achieved according to the invention by control means arranged independently of the lifting device for the carrier such that the control means moves the thread selectively toward and away from the carrier in an oscillating fashion by an incremental "switching amplitude", which may also be referred to as a "switching variable", and is represented in FIG. 24 of the drawings by the variable "S".

By virtue of the fact that the control means are arranged independently of the carrier and thus of the lifting device, the lifting device is relieved of mass and sensitive control elements and can be configured exclusively in accordance with optimal points of view for the lifting movement. The control means, by contrast, are arranged virtually fixed, that is to say they must not also execute the lifting movement of the lifting device, but can be exclusively limited and concentrated on executing the switching amplitude for the purpose of laying in and removing the thread at the carrier in an oscillating fashion. The fixed arrangement also permits drive energy and control signals to be fed in a simple way independently of wear, as well as permitting a large degree of flexibility in the control possibilities. Further decisive advantages result from this such as, on the one hand, smaller drive motors for the lifting device and, on the other hand, smaller actuators for the control means, a lesser energy requirement for the drive means, and thus not only a more cost effective production but also a more cost effective operation despite higher power. This also leads to less development of heat, which finally also has the effect of simplifying and lowering the cost of air conditioning for the operating rooms in which such devices are set up. Furthermore, such a device is also easier to access, and this facilitates laying in the thread. This is supported further by the insensitivity of the components.

The use of a novel thread control device in a shedding mechanism for warp thread control in a weaving machine provides substantial advantages there of the type mentioned above.

The substantially lower number, in particular, also of the moving components, and thus a reduction in the moving masses permits higher drive speeds and thus higher production performances, it being the case, nevertheless, that there is a large reduction in wear and in the emission of noise and vibration by comparison with conventional thread control devices, in particular shedding mechanisms of a weaving machine. The invention opens up the possibility of operating the thread control device, in particular the shedding mechanism, and thus also the connected weaving machine at very high speeds, for example of 5000 revolutions per minute and more.

The elimination of the otherwise customary upstream control devices and of the various connecting elements otherwise required results in further substantial advantages. The fact that a weaving machine equipped with the thread control device according to the invention requires no built-on accessories for upstream shedding mechanisms such as jacquard machines, produces for the weaving machines a large saving in space requirement over the weaving machine, and thus an improvement in the supervision and accessibility of the entire weaving machine, the result being an ergonomically important improvement in the supervision and handling, and thus in the workplace at a thread control device, in particular a shedding mechanism. The work of adjustment and maintenance can therefore be performed in a safe and easy manner.

Advantageous embodiments of the thread control device are described hereafter.

There are various possibilities for constructing the control means. Thus, said possibilities can consist, however, in providing an electric pulse to the threads to be controlled in order to defect the latter toward the carrier by the switching amplitude. However, such a construction is possible only if the thread reacts to a current pulse. In one embodiment which is more advantageous, a control slot ensures a shaped closure capturing of the thread which is also independent of the property of the thread. A development according to a further embodiment is expedient in order to permit guidance along the entire transverse movement or the stroke of the thread.

The lamella-like construction of the control means which covers the carrier likewise having a lamellae-like construction produces a particularly space-saving design, which improves its use, in particular concerning the warp thread control of a weaving machine. In this case, the control means can be developed with two parallel lamellae which enclose lamellae-like carriers between them or at least one further lamellae enclosing a further carrier.

In accordance with another embodiment, the carrier can be effective over the entire transverse movement of the thread. However, a further embodiment having first and second oppositely directed carriers is more advantageous, providing not only a reduction in the stroke path of a carrier, but also an improvement in the control possibilities.

Particularly preferred is an embodiment of the thread control device, according to which the carrier has a carrier hook, effective only in one direction of movement, for shaped closure driving of the thread. In the other direction of movement, the return preferably proceeds in a forced fashion, it being possible for the residual stress of the thread to be sufficient. If appropriate, further additional tensioning devices can be present. In specific cases, it is possible for the thread control device to have a carrier which permits shaped closure driving in both directions of movement of the thread.

There are numerous possibilities for constructing and arranging the carrier. The carrier hook is arranged at the end of the spring tongue and preferably has one run-on guide outside the carrier part. The carrier hook has a thread rejector at the free end, or two carrier hooks pointing away from one another, each having control means for laying in a thread.

They are also given as possibilities for constructing the actuator, a few which are particularly preferred. For example, the actuator may include a piezoelectric switching device or may be constructed as a piston/cylinder unit actuated by a fluid such as air. The actuator may also be constructed as an electromagnet. There are also disclosed a number of possibilities for constructing the actuator. In one case, the actuator can be activated in a drive direction, and can be returned in the other direction by means of a spring.

The control means can be arranged to be capable of being pivoted by the switching amplitude, it preferably being possible for this arrangement to be made on a support rail. The control elements can be arranged in pairs and mounted pivotally on a common support which is fastened to the support rail and has a swinging arm which pretensions the control elements against the actuator. The control element alternatively may have a control stop and a biasing spring which pretensions the control stop against a preferably piezoelectric switching device which releases the control stop in the switching state and brings the control element into engagement with an oscillating actuator.

However, in a preferred embodiment of the thread control device, the control element which can be displaced going to and fro in its longitudinal direction permits numerous variants in terms of arrangement and drive. Thus for example, the actuator can be arranged at the lower end of the control element. It is also possible to design the device in which the control element moving to and fro in the longitudinal direction is pretensioned in one direction at the lower end by means of a return spring and is connected at the upper end with the actuator by means of a connecting element such as a cord. In such a thread control device, the actuator does not have to execute the entire stroke path, but only a part corresponding to the switching amplitude, with the result that the device can be constructed in a substantially simpler and smaller way by contrast with the jacquard device, and that only a smaller amount of energy is required to surmount the switching path by comparison with the existing jacquard devices.

Particular simple and compact designs of the thread control device are possible. For example, the control element moving to and fro in the longitudinal direction may cooperate with a drive element also moving to and fro in the longitudinal direction and against which drive element the thread control is pretensioned by means of a spring. The control element also has a retaining stop with which a controllable switching device, preferably a piezoelectric switching device, can cooperate in such a way that the control element follows the movement of the drive element in the event of an ineffective switching device, and is retained in a position in the event of an effective switching device.

It is expedient for the carrier to be arranged on a lifting rail of a lifting device.

The thread control device is suitable for the most varied applications and so, for example, for optionally presenting a weft thread insertion member with weft threads of different colors and qualities for gripping. However, it is particularly advantageous if the thread control device is made up of components of a shedding mechanism of a weaving machine, a multiplicity of the thread control devices being present for controlling the warp threads of the weaving machine. A dedicated actuator can be present for each control element in order to achieve the greatest possible multiplicity of control possibilities. The design in which the control elements are combined into groups to be driven by a common actuator can also be advantageous for simpler cases.

BRIEF DESCRIPTION OF THE DRAWINGS

Exemplary embodiments of the thread control device according to the invention are described in more detail below with the aid of diagrammatic drawings, in which.

DESCRIPTION OF THE PREFERRED EMBODIMENTS

Figure 1:
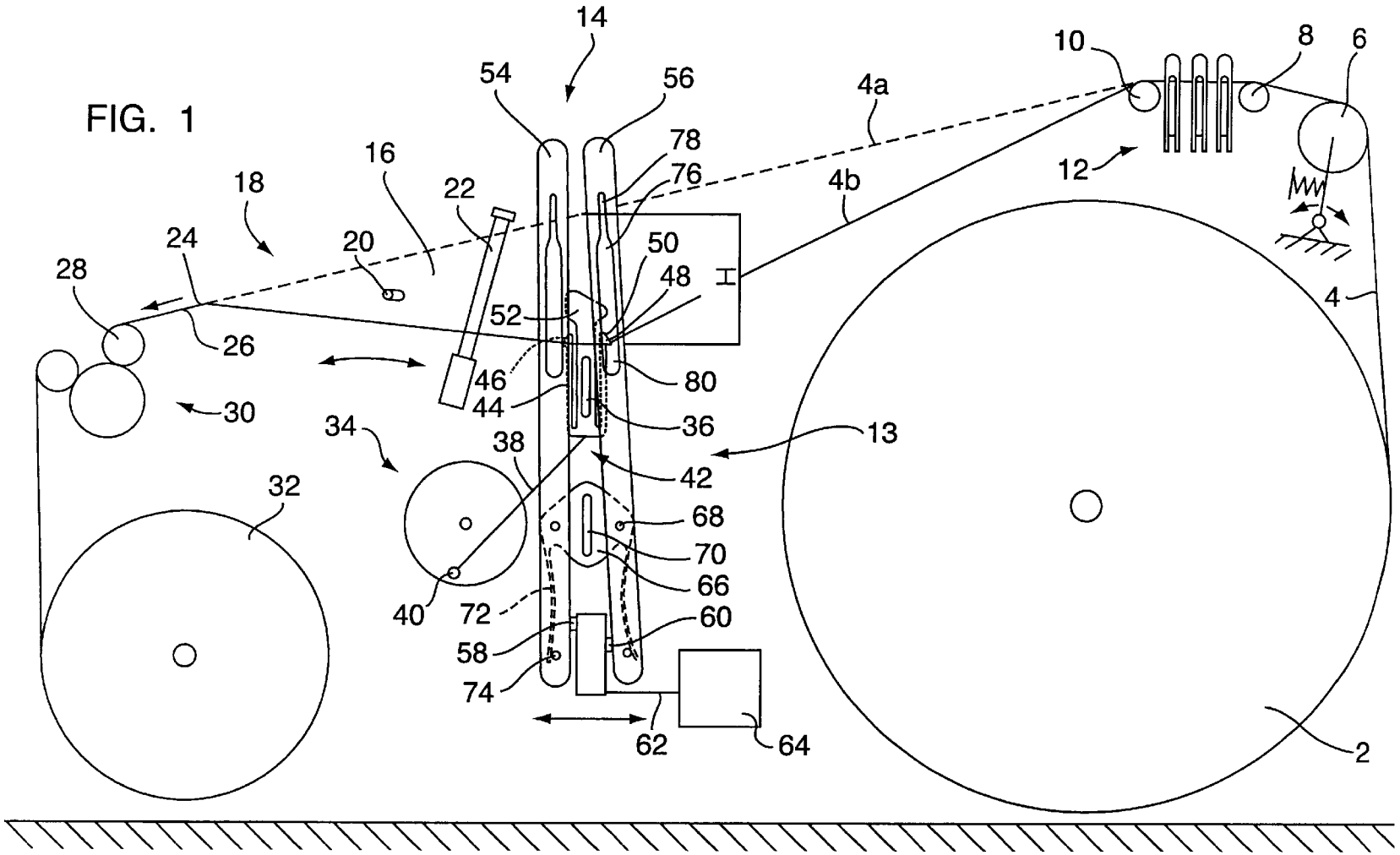
FIG. 1 shows a first thread control device in the shedding mechanism of a weaving machine, in side view.

FIG. 1 shows the diagrammatic design of a weaving machine. Warp threads 4 are drawn off from a warp beam 2 and run via a tensioning device 6 to a first warp guide 8, and further to a second warp guide 10, between which warp feelers 12 are arranged. From the second warp guide 10, the warp threads 4 run via a plurality of thread control devices 14, which are combined to form a shedding mechanism 13 and open the warp threads 4 to form a weaving shed 16, to a weaving station 18 at which weft threads 20 are inserted into the open weaving shed 16 and beaten at a fell 24 by means of a weaving reed 22. The woven web 26 thus produced is guided via the fabric guide 28 of a drawing-off device 30 to a fabric roller 32 and wound on there.

Figure 2:
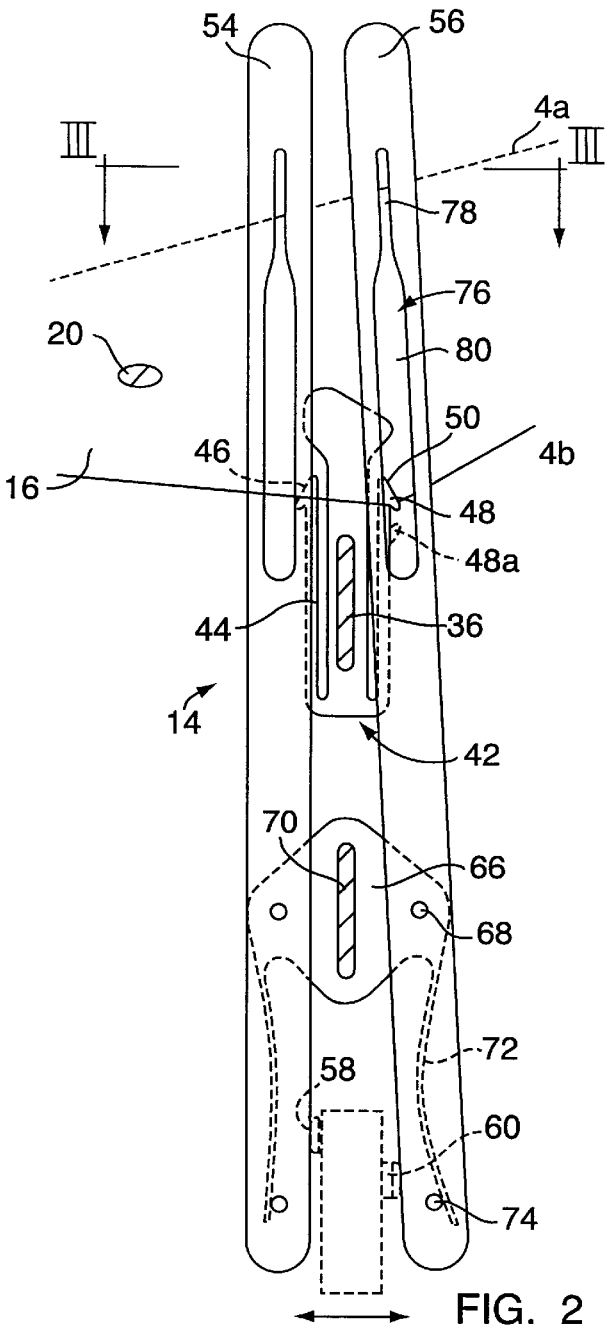
FIG. 2 shows the thread control device of FIG. 1 on a larger scale.
Figure 3:
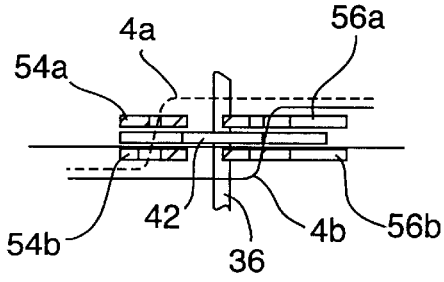
FIG. 3 shows the thread control device of FIG. 2 in the section III—III of FIG. 2.

The shedding mechanism 13 is formed from individual thread control devices 14 represented in detail in FIGS. 2 and 3, and includes a lifting device 34 having a lifting rail 36 which can be moved up and down, for example via a connecting rod 38 by a driven eccentric 40. Lined up on the lifting rail 36 are carriers 42 which are constructed like lamellae and have on mutually opposite sides spring tongues 44 at whose free ends there is arranged in each case a carrier hook 46, 48 for gripping one warp thread 4*a*, 4*b* each. Each carrier hook is provided at the free end with a run-on guide 50, in order to facilitate engagement of the warp thread. Positioned above the carrier hooks 46, 48 is a thread rejector 52 whose purpose is to prevent undesired engagement of warp threads on the carrier hook 46, 48.

For each carrier hook 46, 48, each carrier 42 is assigned control elements 54, 56 which can be controlled by means of an actuator 58, 60 in order to bring an assigned warp thread 4*a*, 4*b* into engagement with the carrier hook 46, 48 of the carrier. The actuators 58, 60 are connected via a line 62 to a control device 64 which the actuators control in terms of pattern in accordance with the web to be produced, doing so in a way which, although not represented in more detail, is known. Each control element 54, 56 comprises two control lamellae 54*a*, 54*b* and 56*a*, 56*b*, respectively, which enclose the carrier 42 between them. The control elements 54, 56 and/or their control lamellae 54*a*, 54*b* and 56*a*, 56*b*, respectively, are mounted on a common support 66 such that they can pivot about bolts 68, the pivoting path corresponding only to the switching amplitude required to insert the warp thread into the carrier and bring it out of it. The support 66 is lined up on a fixed support rail 70 and includes spring arms 72 which operate in each case with a stop 74 between the control lamellae 54*a*, 54*b* and 56*a*, 56*b* respectively, and pretension the latter against the actuator 58, 60.

As emerges from FIGS. 1 and, in particular 2 to 20, the control elements include slots 76 which, in the basic position of the warp threads 4*a*, 4*b* are constructed as narrow control slots 78 which merge in the lifting direction into wide guide slots 80.

Figure 9:
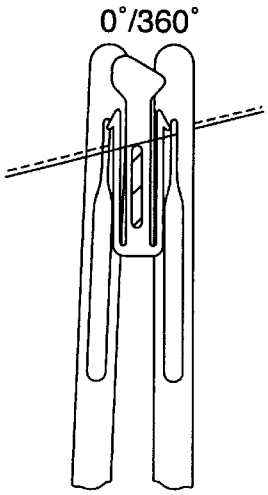
Figure 10:
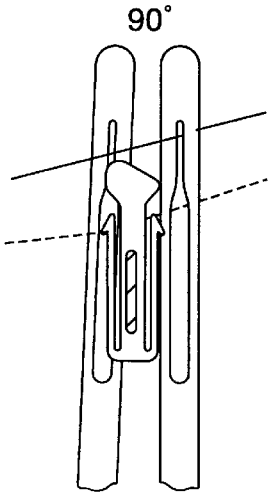
Figure 11:
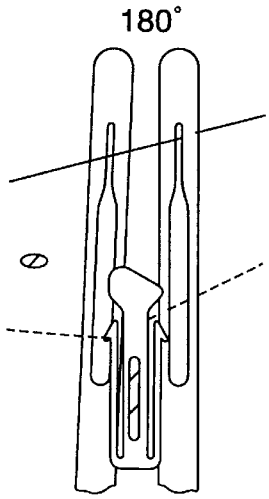
Figure 12:
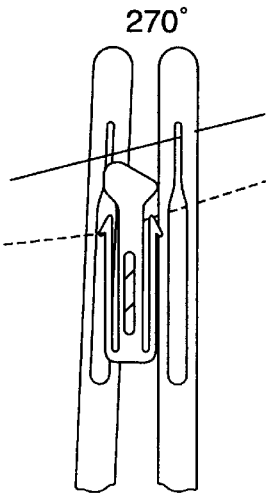
Figure 13:
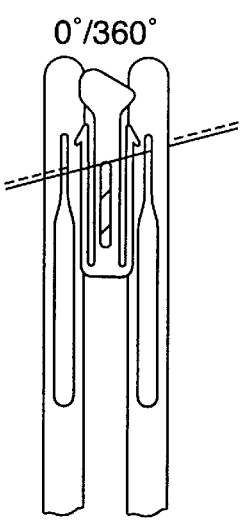
Figure 14:
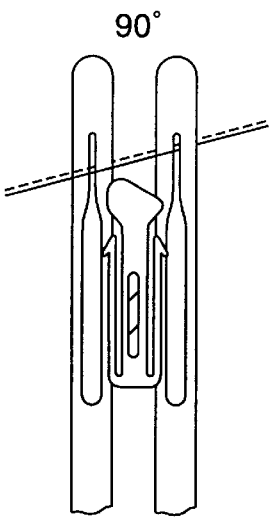
Figure 15:
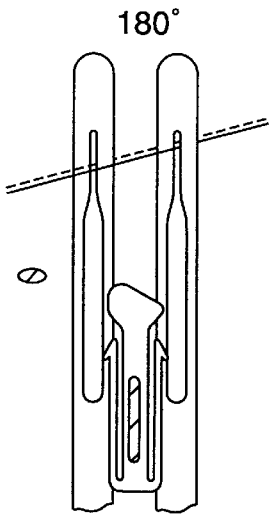
Figure 16:
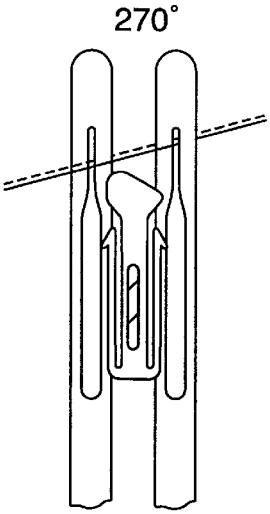
Figure 17:
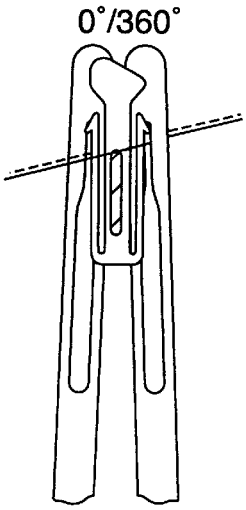
Figure 18:
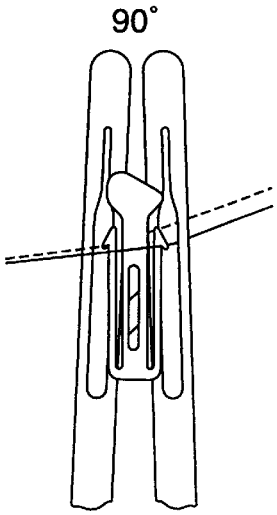
Figure 19:
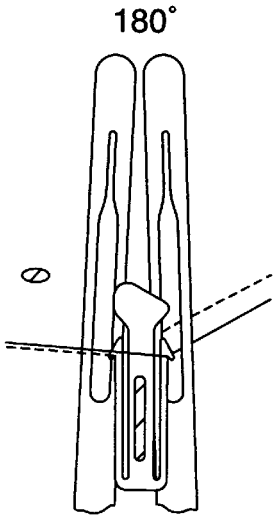
Figure 20:
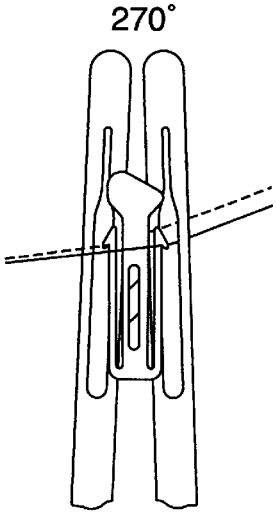

The mode of operation of the shedding mechanism follows very clearly from FIGS. 1 to 20. The basic position of the warp threads is determined by the straight connection between the second warp guide 10 and the fabric guide 28. This basic position also corresponds to the high position of the warp shed from which the warp threads 4, 4*a*, 4*b* are brought selectively by the stroke H into the low position, as is to be seen from the figures. A warp thread 4, 4*a*, 4*b* is driven only if the warp thread is brought by means of the associated control element 54, 56 into engagement with the associated carrier hook 46, 48 in the high position thereof (FIGS. 5, 9 and 17). For this purpose, an appropriate actuator 58, 60 is activated via the control device 64, and pivots the associated control element 54, 56 against the associated carrier hook 46, 48, with the result that upon the downward movement of the carrier 42 the warp thread is driven by the carrier hook 46, 48 and brought into the low position (FIGS. 1, 2, 7, 11 and 19). The warp thread is returned from the low position into the high position with the upward movement of the carrier 42 primarily by the residual stress of the warp thread. The upward movement can be further supported by laying the warp thread on the lifting rail, which is arranged directly below the carrier hook. The carrier hook could, if appropriate, also be constructed as a double hook 48*a*, as is indicated by dashes in FIG. 2. The warp thread is directed out of the carrier hook 46, 48 when the carrier 42, and thus the warp thread 4*a*, 4*b*, has reached the basic position. The actuator 58, 60 is then switched to be inactive, as a result of which the control element 54, 56 is pivoted back, under the influence of the pretensioning of the spring arm 72, into the basic position (FIGS. 13 to 16), in which the warp threads cannot be driven by the carrier 42.

Figure 4:
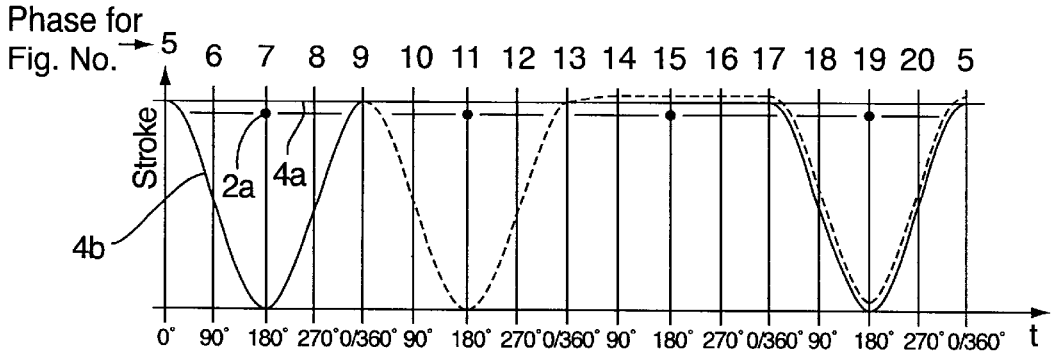
FIGS. 4 to 20 show a diagram of the movement of the thread control device of FIGS. 1 to 3 in various control phases in accordance with FIGS. 5 to 20, the carriers being represented in an open fashion in FIGS. 5 to 20, that is to say for the purpose of better understanding, the part of the control means situated in the foreground has been omitted.
Figure 5:
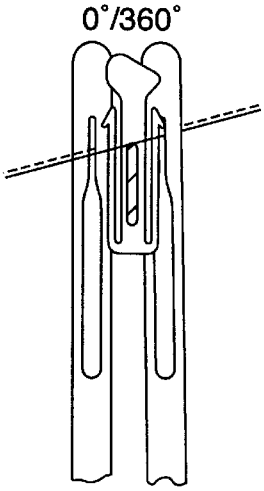
Figure 6:
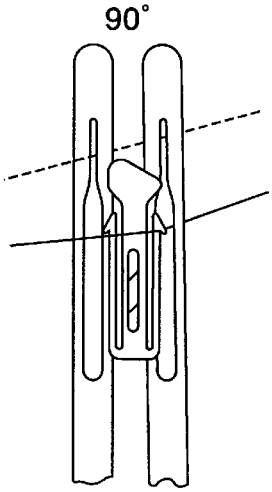
Figure 7:
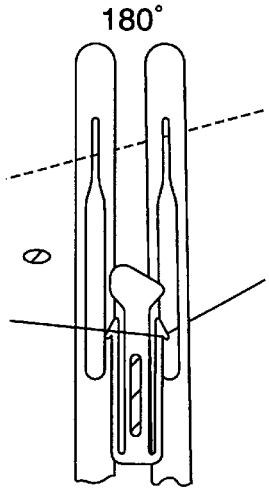
Figure 8:
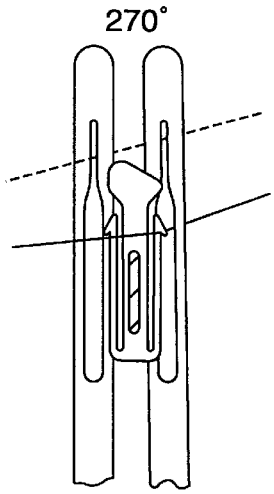

The carrier 42 is equipped in the present example with two carrier hooks 46, 48, and two control elements 54, 56 are assigned correspondingly, with the result that one carrier can move two warp threads 4*a*, 4*b* selectively out of the upper shed position into the lower shed position, as shown, in particular, by the diagram in FIG. 4 and the associated phase drawings of FIGS. 5 to 20. It is therefore necessary to arrange on a lifting rail 36 only half as many carriers 42 as there are warp threads present, and on a support rail 70 a number of control elements 54, 56 which corresponds to the number of the warp threads. The carriers 42 constructed like lamellae and control elements 54, 56 are configured to be correspondingly thin and can, for example, be 0.1 to 0.5 mm thick. If appropriate, it may be expedient to distribute the required number of carriers 42 and control elements 54, 56 over two and more lifting rails 36 and support rails 70.

As shown by the above embodiments, no spring returns are required with the novel shedding mechanism, and the components required to control the warp threads are reduced to a minimum because of the direct control of the warp threads, as a result of which there is a very considerable reduction in the drive forces by comparison with conventional devices. This leads, on the one hand, to a substantial saving in energy and, on the other hand, it opens up the possibility of operating such a weaving machine with a substantially higher speed of, for example, 5000 or more revolutions per minute.

Figure 21:
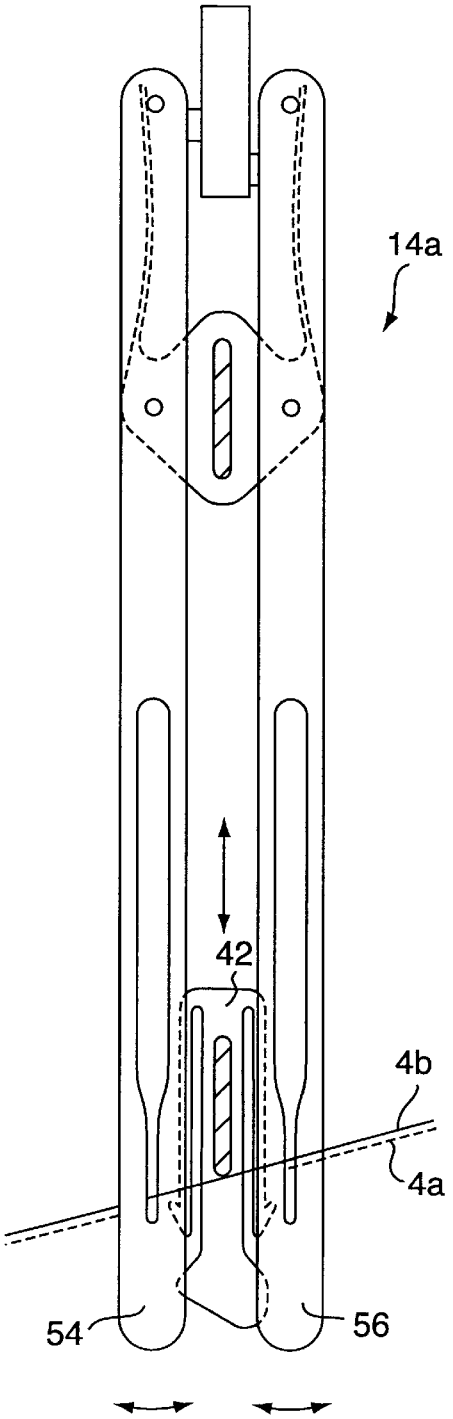
FIG. 21 shows the thread control device of FIGS. 1 to 20, working from the basic position into a high position.

FIG. 21 describes a thread control device 14*a* which corresponds essentially to that of FIGS. 1 to 20, the thread control device being arranged, however, not below the web prescribed by the warp threads 4*a*, 4*b* but above it, with the result that the neutral position of the warp threads corresponds to the lower shed position, and the warp threads are deflected into the upper shed position by means of the carrier 42.

Figure 22:
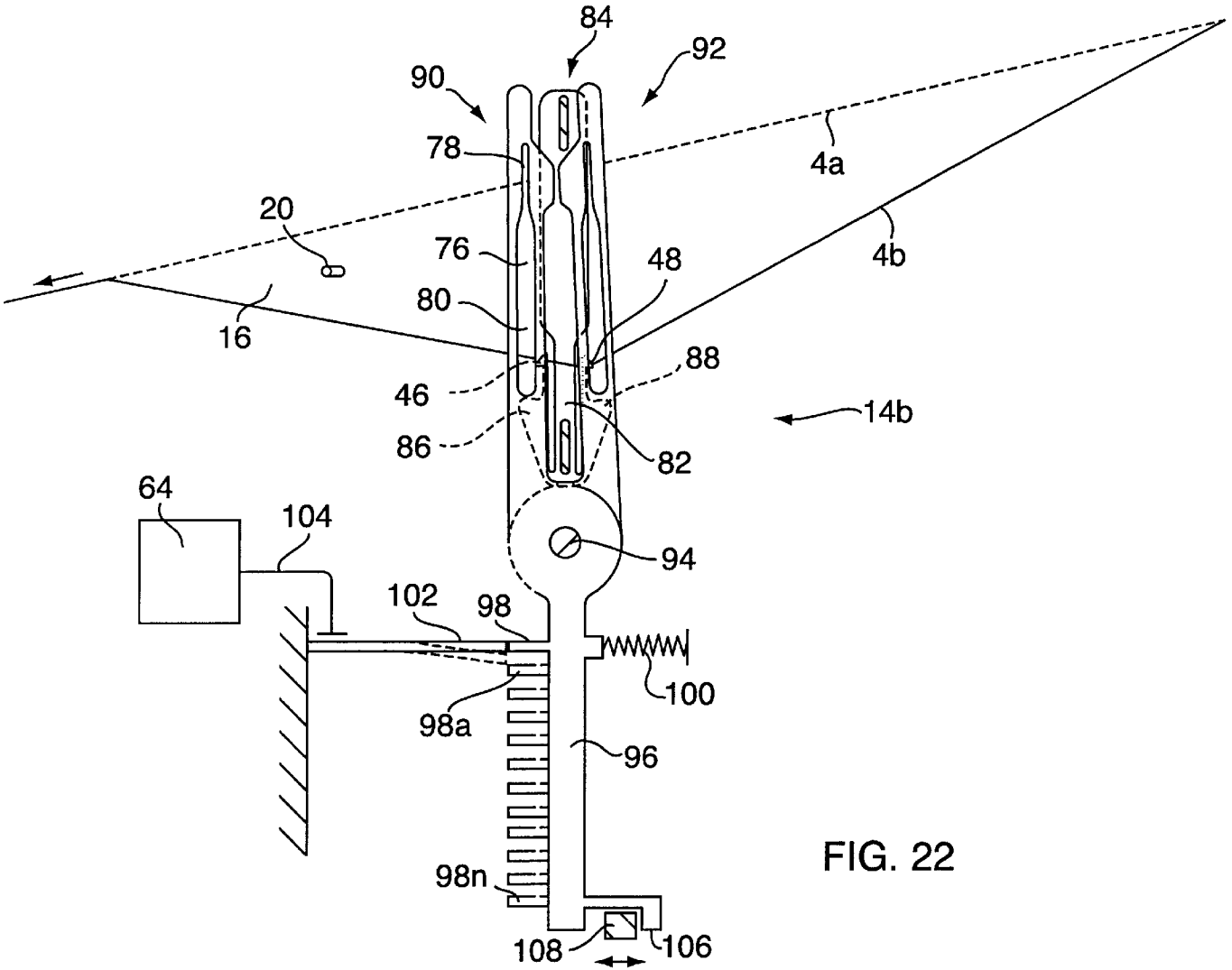
FIG. 22 shows a third thread control device having a piezoelectric control.

In the shedding mechanism represented in FIG. 22 and formed from thread control devices 14*b*, the carriers 82 are lined up on a lifting rail which forms part of a metal heald frame 84 which is moved up and down in a known way. The carriers, in turn, include carrier hooks 46, 48 and projections 86, 88 which serve to support the return of the warp threads into the initial position. Assigned to the carrier 82 or the carrier hooks 46, 48 are control elements 90, 92 which, in turn, include a slot 76 having a control slot 78 and a guide slot 80, and are mounted pivotably on a support rail 94. Each control element has an actuating arm 96 on the side opposite from the warp threads 4*a*, 4*b*. Each actuating arm 96 includes a control stop 98 and a biasing spring 100, which pretensions the control stop 98 against a switching device 102, a so-called flexural vibrator, which is at an electric potential thereto. If the switching device 102 is not activated, the control stop 98 rests on said switching device and the control device remains in the neutral basic position. If, however, the switching device 102 is activated via a line 104 by means of the control device 64, the switching device 102 pivots into the position shown by dashes, and the switching device 90 can pivot under the influence of the biasing spring 100 and share in the movement of an actuator 106 in the form of a driven control strip which engages in a driving groove 108 at the lower end of the actuating arm 96. This driving groove 108 has a width such that it can move freely when the actuating arm 96 is stopped in the basic position by the switching device 102. With the switching device 102 activated, the biasing spring 100 pretensions the actuating arm 96 against the control strip 106, with the result that the actuating arm shares in the movement of the control strip 106, the control element 90 or 92 thereby engaging the corresponding warp thread 4*a*, 4*b* with the associated carrier hook 46, 48. The control stops 98a to 98n represented by dashes in FIG. 22 correspond in each case to a control element following in the sequence, which respectively cooperates in turn with a dedicated switching device (not represented).

Figure 23:
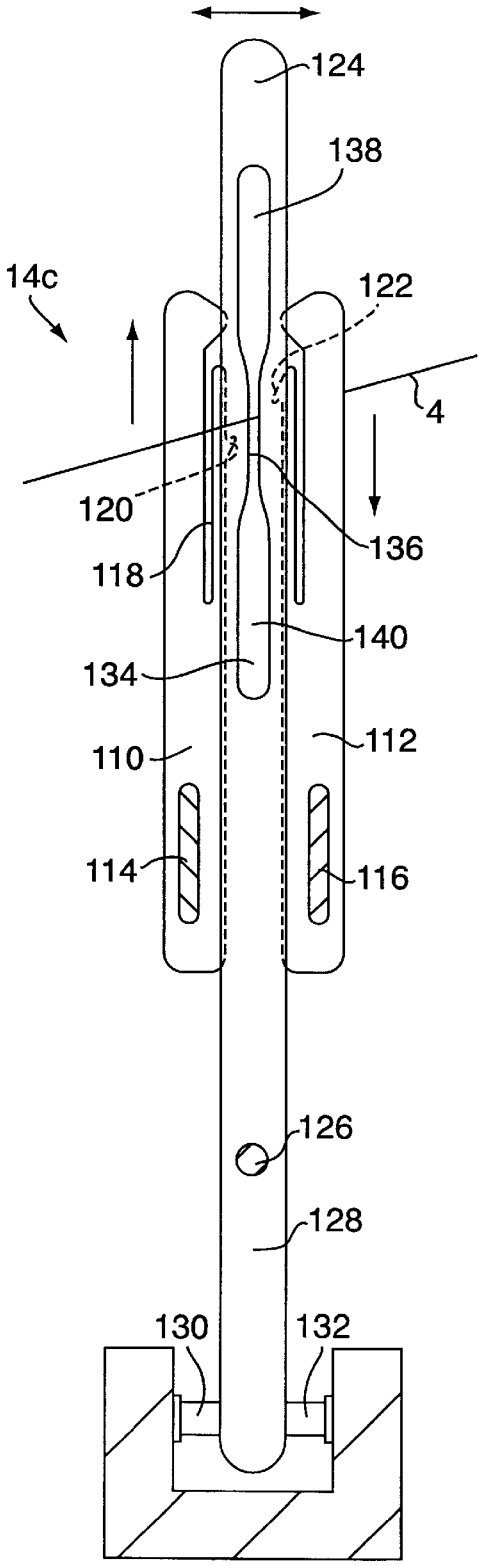
FIG. 23 shows a fourth control device having a control element and two carriers, working from a middle basic position.

FIG. 23 describes a thread control device 14*c*, in which a warp thread 4 is assigned two carriers 110 and 112 which move the warp thread from the neutral position of the warp threads, which corresponds to the middle shed position, into the upper shed position or into the lower shed position, respectively. The carriers 110, 112 are arranged on corresponding lifting rails 114,116 and in each case have a carrier hook 120, 122 at the end of a spring tongue 118. Assigned to the two carriers 110, 112 is a common control element 124 which is mounted pivotably on a support rail 126 and has on the side opposite from the warp thread 4 an actuating arm 128 which cooperates with two actuators 130, 132 which act opposed to one another and pivot the control element 124 against one or other of the carriers 110, 112. The control element 124 is provided, in turn, with a slot 134 for controlling the warp thread, which is constructed in the neutral position of the warp thread 4 as a narrow control slot 136 which then merges both upward and downward into wide guide slots 138,140. This thread control device functions similarly to the thread control device described at the beginning.

Figure 24:
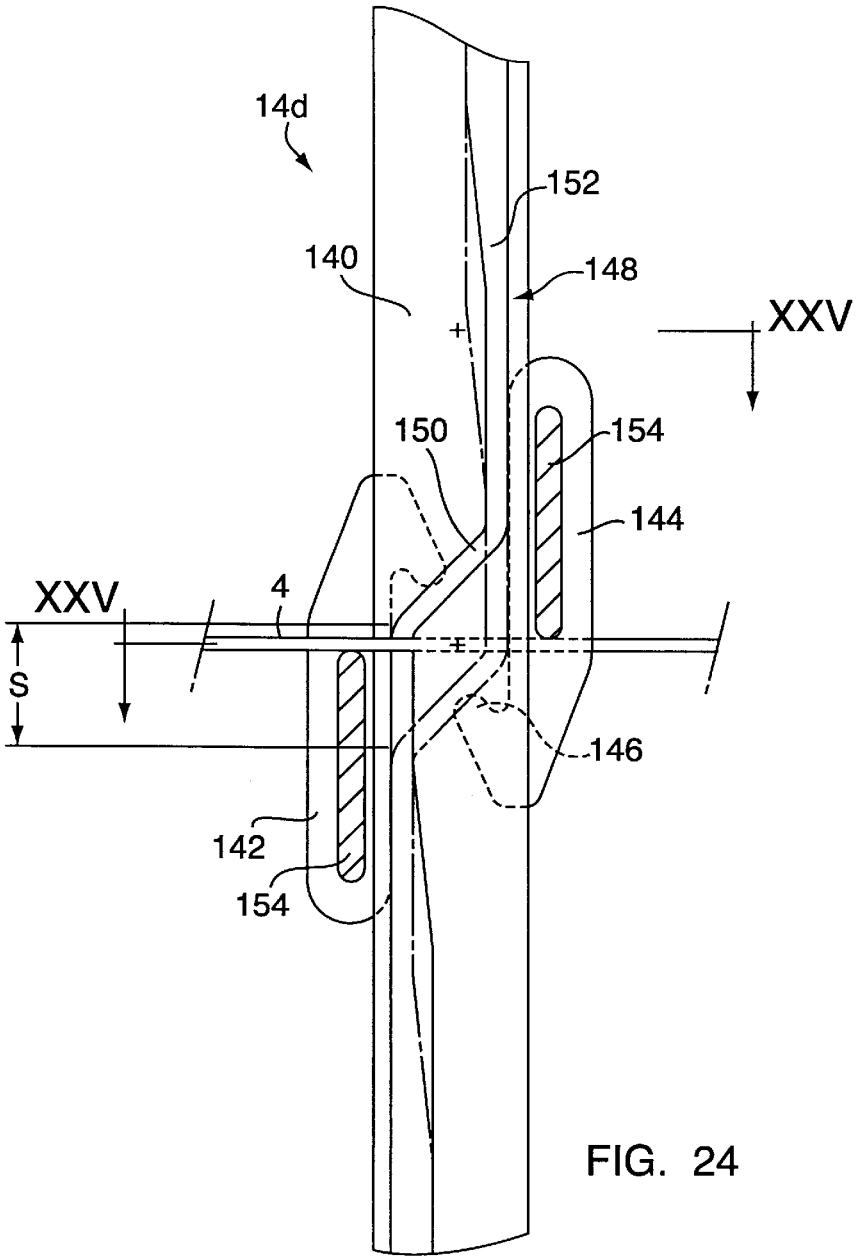
FIG. 24 shows a fifth thread control device having a control element, oscillating in the longitudinal direction, comprising two lamellae and assigned carriers.
Figure 25:
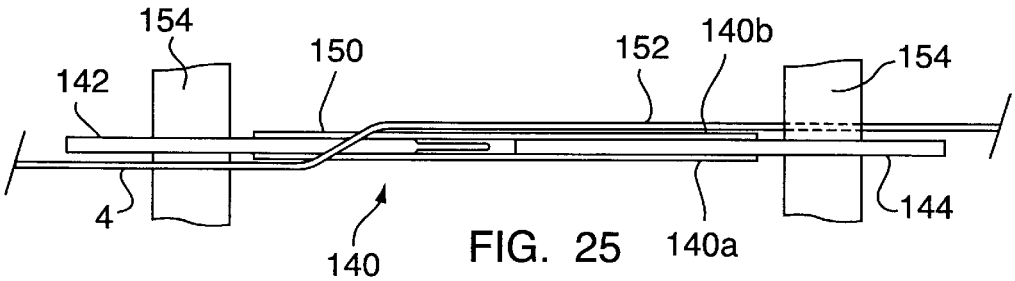
FIG. 25 shows the thread control device in section XXV-XXV of FIG. 24, on a larger scale.

FIGS. 24 and 25 show a further thread control device 14*d* having a control element 140 to which carriers 142,144 having carrier hooks 146 are assigned on each side. The carriers 142, 144 run in opposite directions and move downward or upward, respectively, from the middle position shown in FIG. 24. The control element 140 includes a slot 148 which is constructed in the middle position as a control slot 150 and which is adjoined by guide slots 152 on both sides. The control slot 150 is arranged at an angle relative to the longitudinal direction of the control element 140 in such a way that when the latter moves longitudinally in an oscillating fashion, the control element is moved by the switching amplitude S, as is represented by dashes in FIG. 24. When the control element is moved from the position represented by full lines in FIG. 24 into the position represented by dashes, the warp thread 4 is transferred from the carrier region of the left-hand carrier 142 into the carrier region of the right-hand carrier 144, with the result that when executing its lifting movement by means of the lifting rail 154 of the lifting device (not represented in more detail) the latter carrier can be transferred from the middle position into the upper shed position. As emerges, in particular, from FIG. 25, the control element 140 is constructed like a lamella and comprises the control lamellae 140*a* and 140*b* which enclose between them over a portion of their width the carriers 142,144 which are likewise constructed like lamellae.

Figure 26:
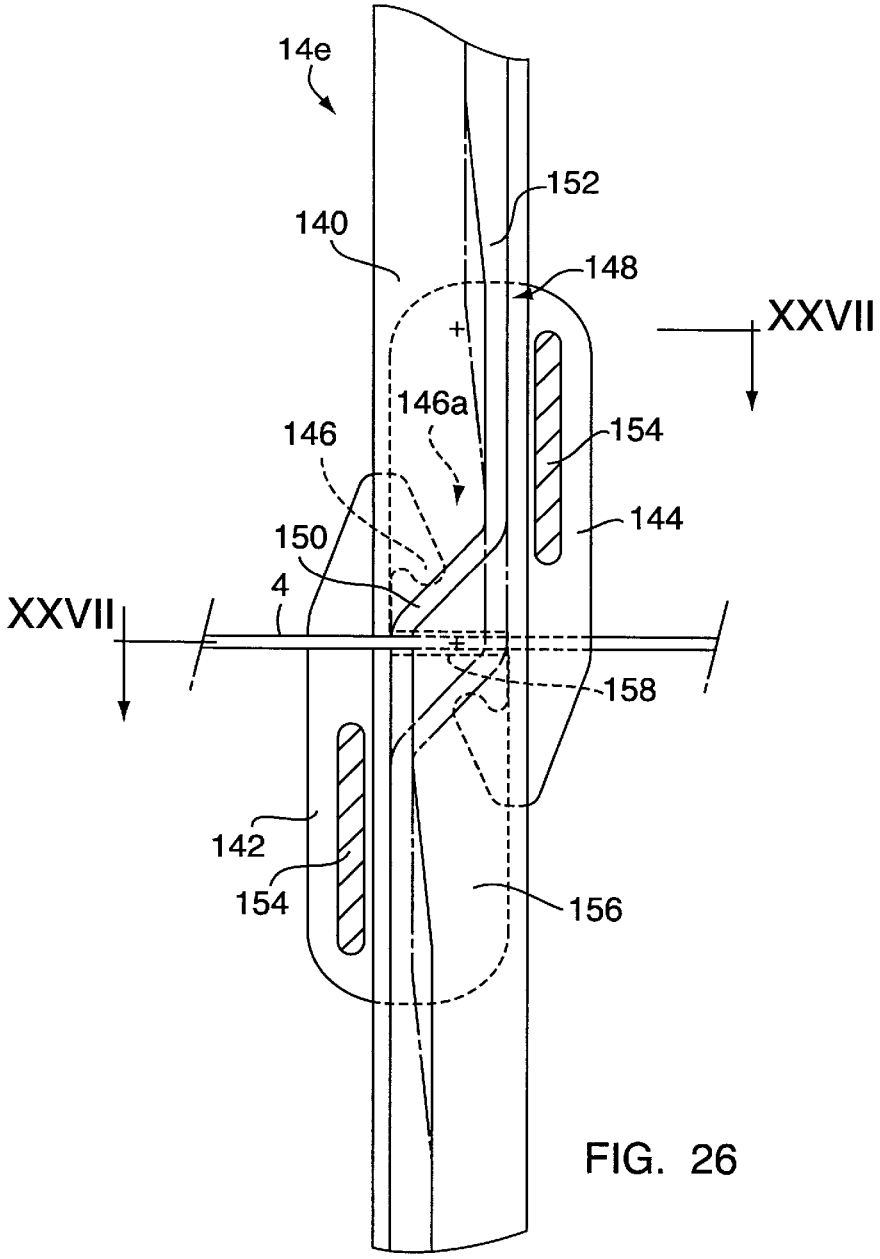
FIG. 26 shows a sixth thread control device similar to FIGS. 24 and 25, but having a control element comprising three lamellae and assigned carriers.
Figure 27:
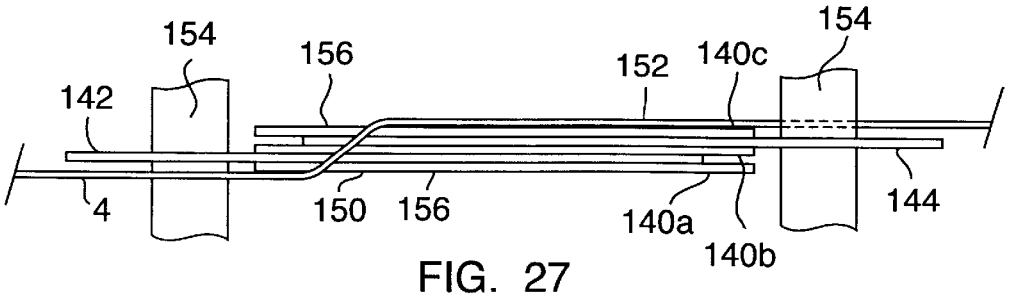
FIG. 27 shows the thread control device of FIG. 26 in section XXVII—XXVII on a larger scale.

FIGS. 26 and 27 show a thread control device 14*e* which corresponds to that of FIGS. 24 and 25, the control element having a further control lamella 140*c*, with the result that the carriers 142, 144 are respectively arranged between mutually separated control lamellae 140*a*, 140*b* or 140*b* and 140*c*. Consequently, the control lamellae can be of wider design and can have a larger degree of coverage with the control lamellae, and thus an improved guidance. In this case, the carriers 142,144 can have a section 156 which covers the carrier hook 146 and which cooperates in the manner of a double hook 146*a* to return the warp thread 4 from the upper or lower shed position and thus support the active control of the warp thread. In the middle shed position represented in FIG. 26, the widened sections 156 of the carriers 142, 144 form a gap 158 which supports the transfer of the warp thread along the control slot 150 out of one switching position into the other switching position.

Figure 34:
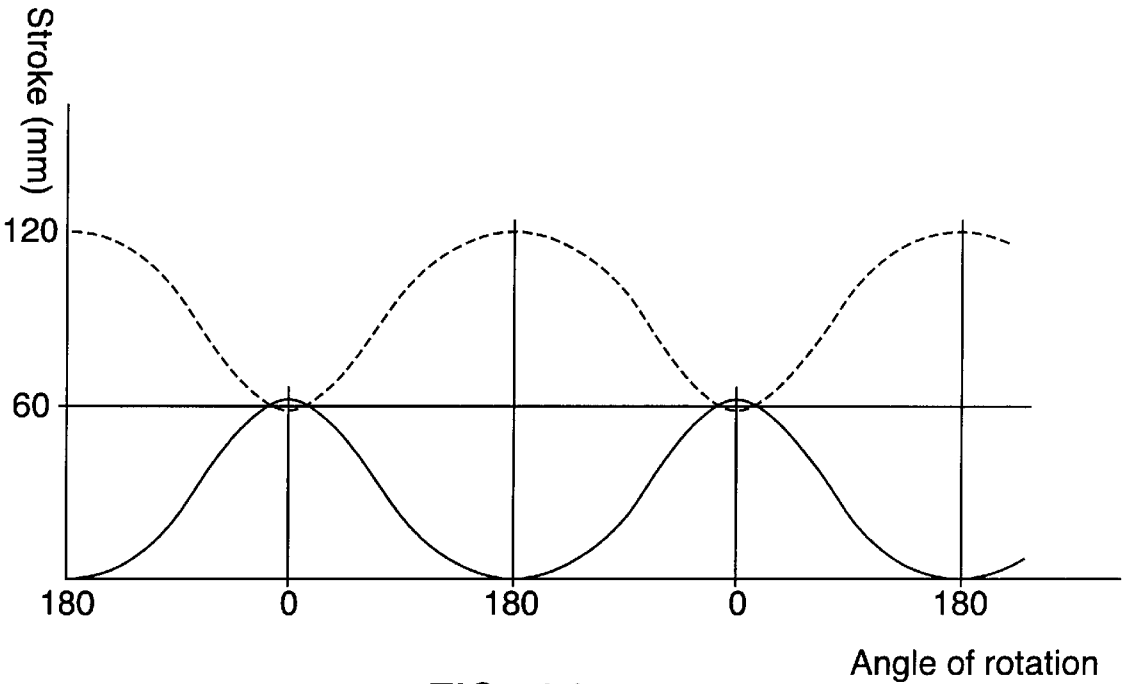
FIG. 34 shows the movement diagram for the movement phrases of FIGS. 29 to 33.
Figure 28:
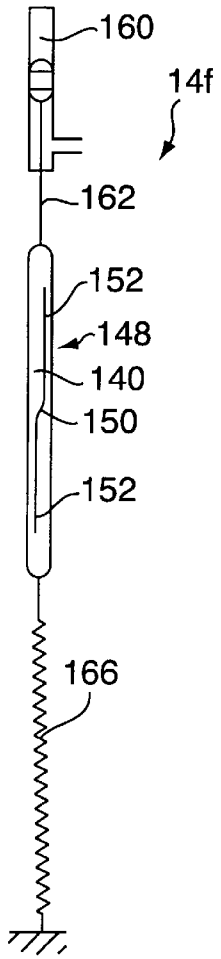
FIG. 28 shows a seventh thread control device similar to FIGS. 24 to 27 and having an actuator, in a diagrammatic representation.
Figures 29, 30, 31, 32, 33:
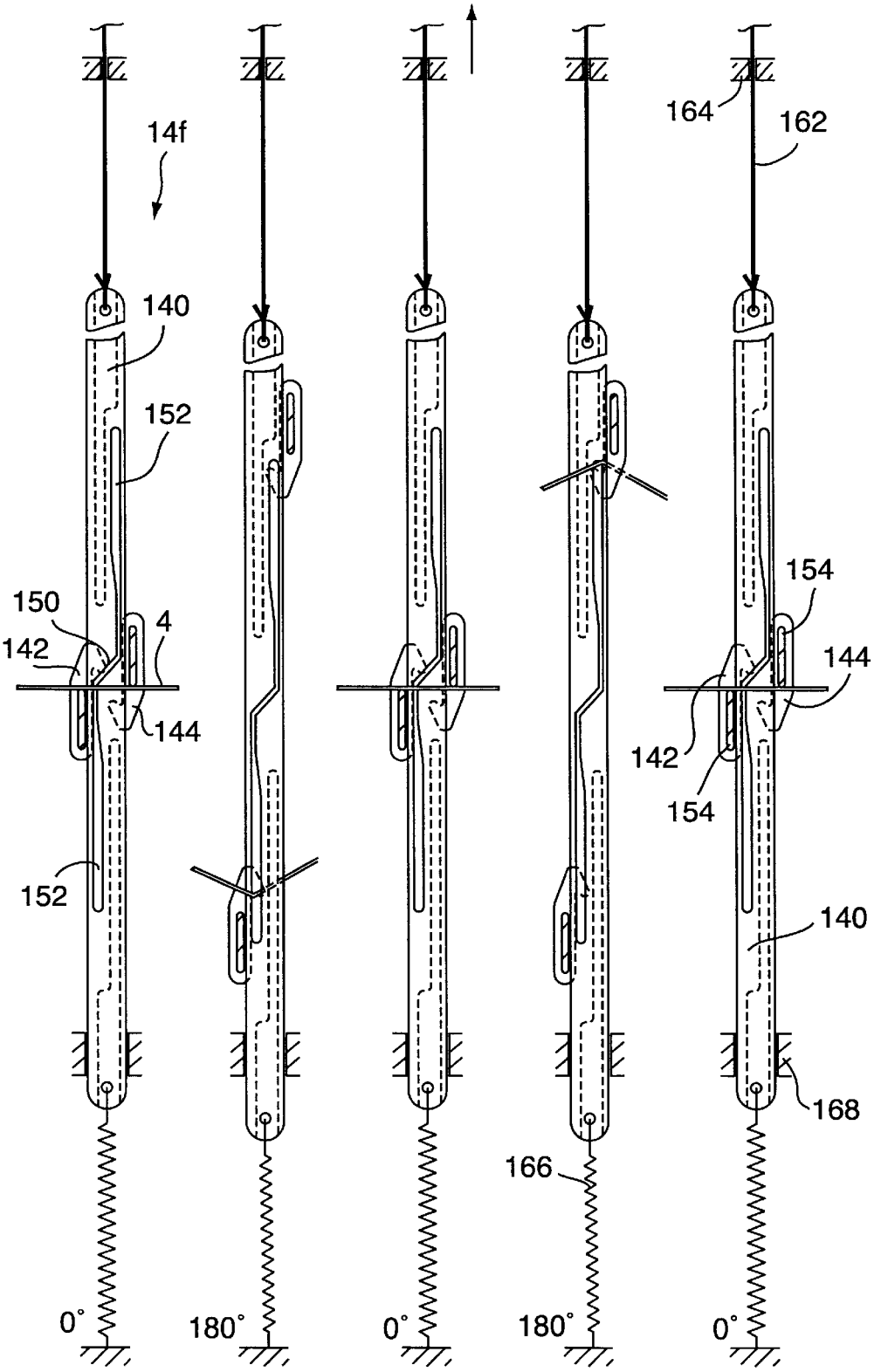
FIGS. 29 to 33 show various control phases of the thread control device in FIGS. 24 to 28.

FIGS. 28 to 33 show the further design and driving of the thread control devices 14*f* according to FIGS. 24, 25 and 26, 27, respectively, on the one hand, and different phases of the movement cycle during control of the warp thread, on the other hand. In the case of the control elements 140 shown in FIGS. 28 to 32, the control element 140 is controlled by means of an actuator 160 which is driven pneumatically and to which the control element 140 is connected via a harness cord 162 which is guided from the actuator 160 via a cord board 164 to the control element 140. The actuator serves primarily for the upward stroke, while the return movement is performed by a return spring 166 which is connected to the lower end of the control element 140, which end is guided by a guide 168. The movement cycle of the carriers 142, 144 is represented in the movement diagram of FIG. 34. In accordance with FIG. 29, the warp thread 4 is moved out of the middle shed position into the lower shed position in accordance with FIG. 30 by means of the left-hand carrier 142. From this position, it then passes again into the middle shed position in accordance with FIG. 31 when the carrier 142 moves back, the warp thread 4 being transferred in the right-hand carrier 144 by means of the control slot 150 of the control element 140. Said carrier 144 drives it into the upper shed position in accordance with FIG. 32, from which it then passes again into the middle shed position in accordance with FIG. 33 by means of the right-hand carrier 144.

Figure 35:
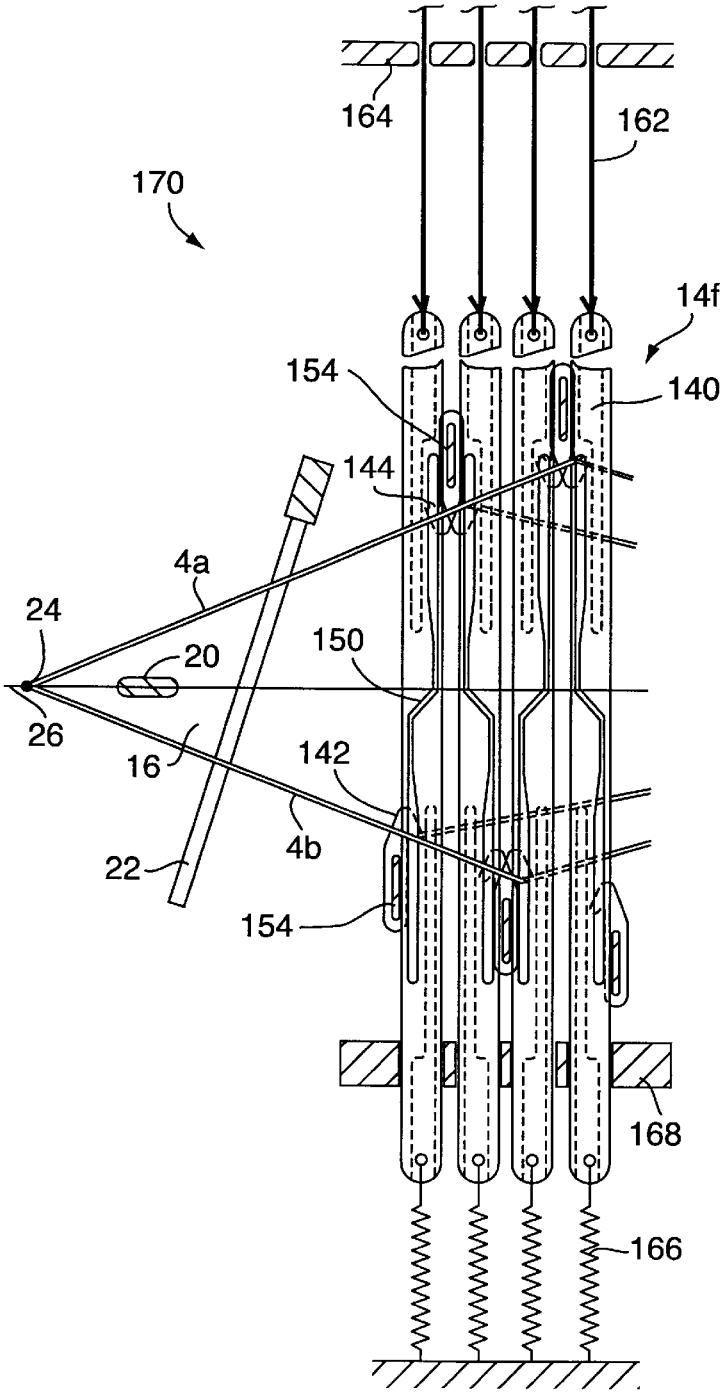
FIG. 35 shows the thread control device of FIGS. 24 to 33 in the shedding mechanism of a weaving machine in the open shed position.
Figure 36:
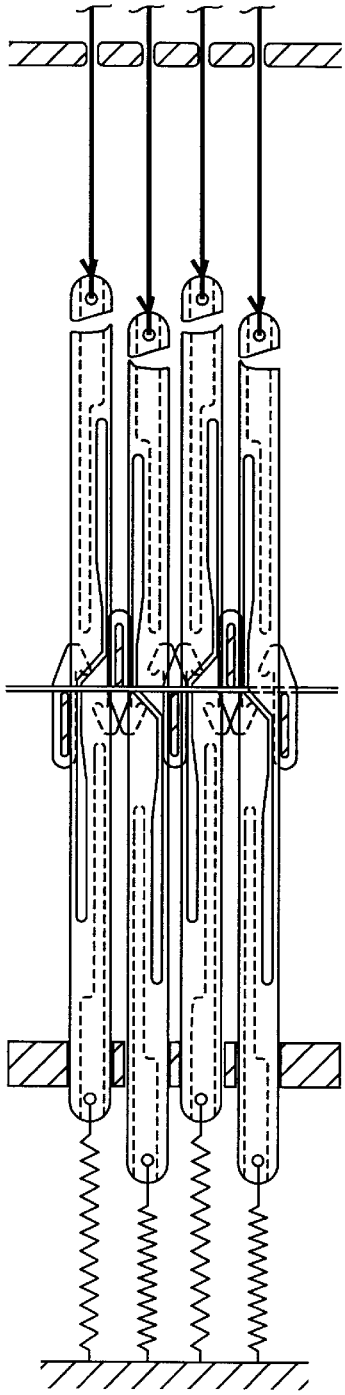
FIG. 36 shows the shedding mechanism of FIG. 35 in closed shed position.

FIGS. 35 and 36 show the arrangement of a plurality of thread control devices 14*f* in accordance with FIGS. 28 to 33 in a shedding mechanism 170 of a weaving machine, it being possible for such thread control devices to be arranged both in a row one behind another and in a plurality of rows next to one another, depending on the count of the web 26 to be produced or on the count of the warp threads 4*a*, 4*b* to be controlled. FIG. 35 shows the shedding mechanism in open shed position, the waft thread 20 being inserted into the weaving shed 16 and then beaten at the fell 24 by means of the weaving reed 22. The shedding mechanism is represented in the closed shed position in FIG. 36.

Figure 37:
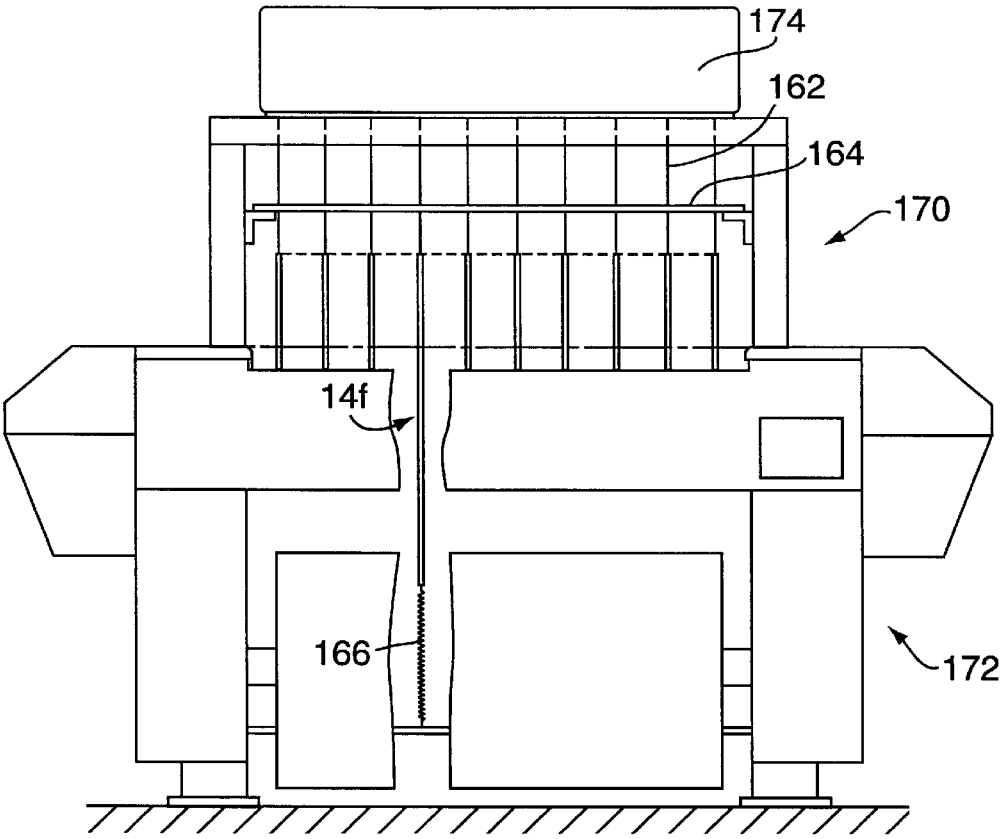
FIG. 37 shows a weaving machine having a thread control device in accordance with FIGS. 35 and 36 and having individual repeat control, in a view onto the front side.
Figure 38:
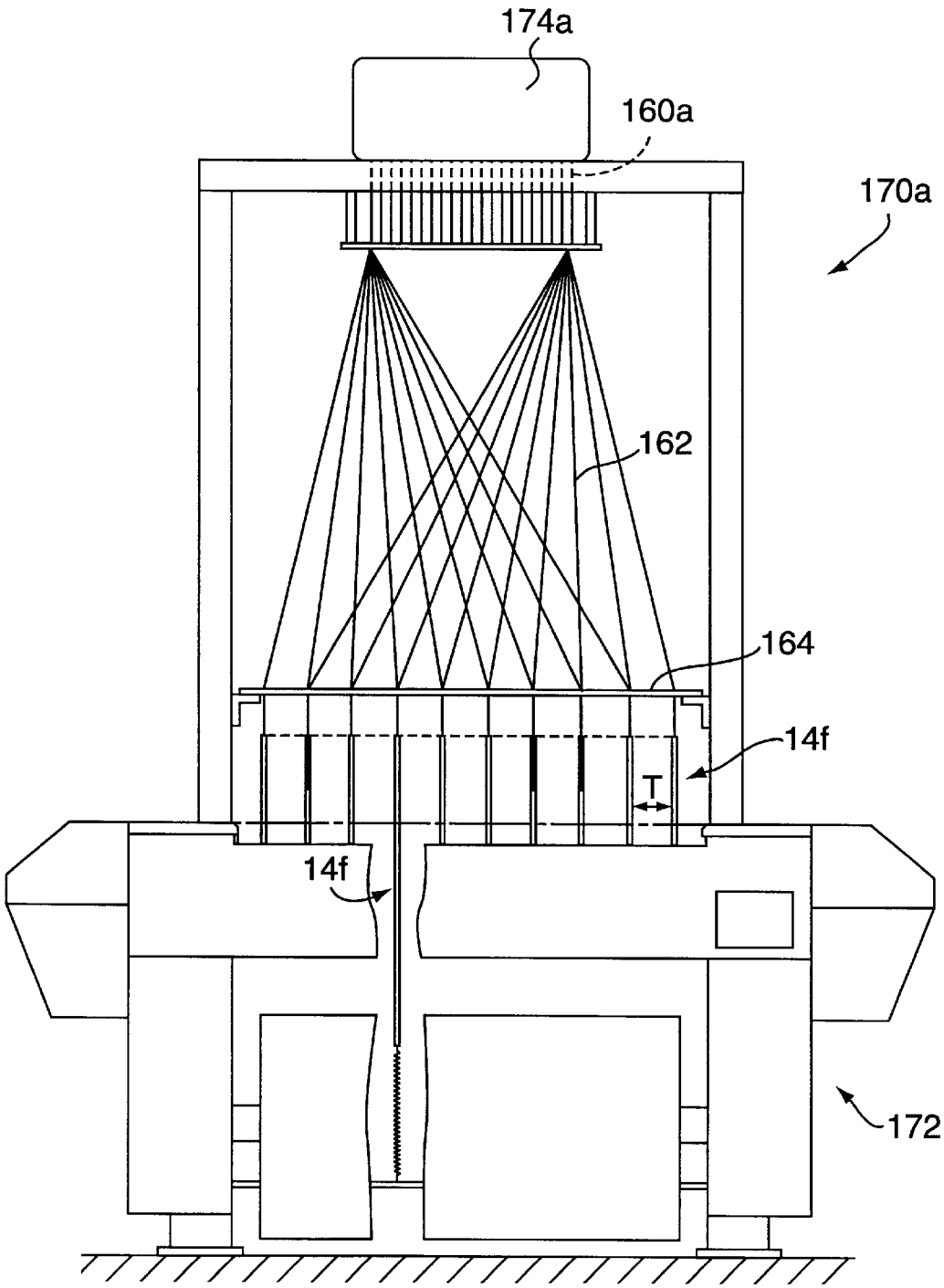
FIG. 38 shows a further weaving machine having thread control devices in accordance with FIGS. 35 and 36, the actuators driving a plurality of control elements in terms of repeat.
Figure 39:
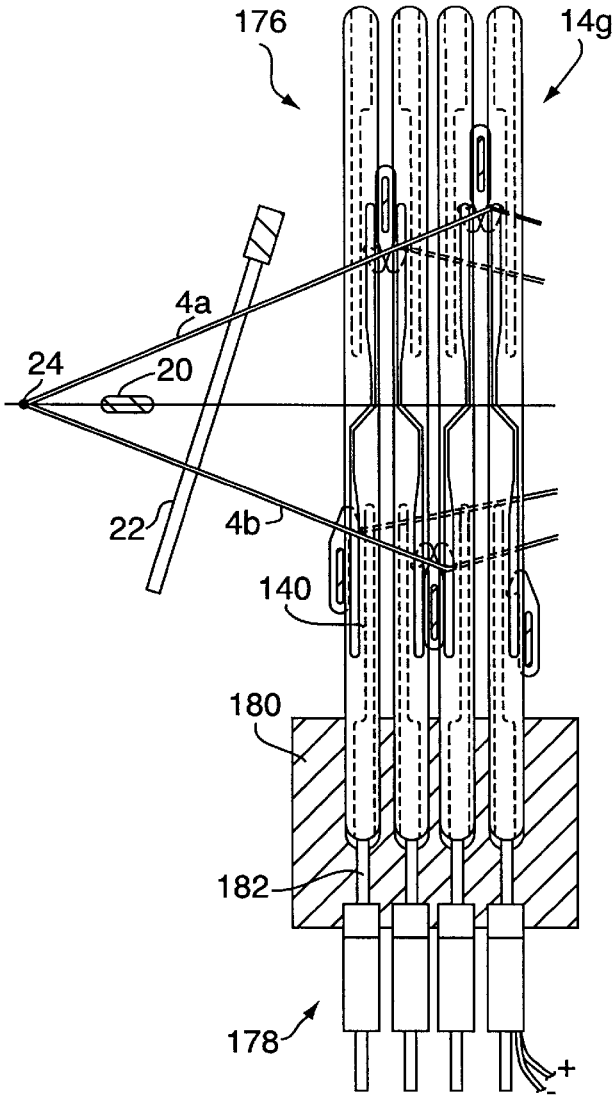
FIG. 39 shows an eighth thread control device similar to FIGS. 24 to 27 and having a modified actuator in a shedding mechanism in open shed position.
Figure 40:
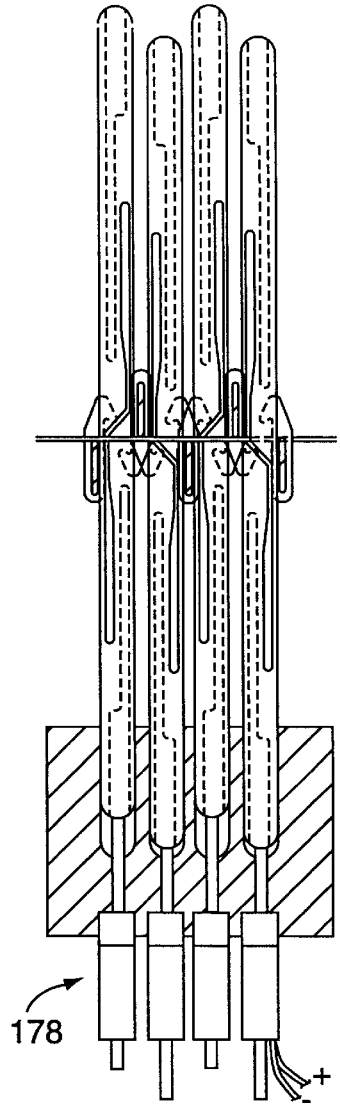
FIG. 40 shows the shedding mechanism of FIG. 39 in closed shed position.

FIG. 37 shows the front view of a weaving machine having thread control devices 14*f* in accordance with FIGS. 35 and 36 and the shedding mechanism 170. As emerges from FIG. 37, the weaving machine includes a machine frame 172, in which the shedding mechanism 170 is arranged with the thread control devices 14*d*, 14*e* and 14*f*, and which serves to control warp threads (not represented in more detail) directly in terms of repeat. Each control element 140 is pretensioned downward via the return spring 166 and connected, via the harness cord 162, which is guided through the cord board 164, to a selecting device 174 which contains the actuators 160. FIG. 38 shows a further weaving machine, in which an actuator 160*a* of the selecting device 174*a* and the shedding mechanism 170*a* simultaneously operates a plurality of control elements in accordance with a warp repeat T.

Figure 42:
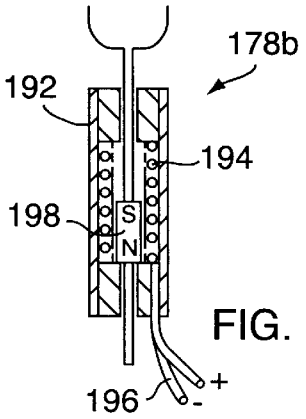
FIG. 42 shows the actuator of the shedding mechanism of FIGS. 39 and 40, designed as an electromagnet.
Figure 41:
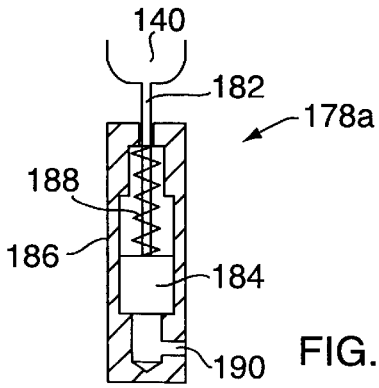
FIG. 41 shows the actuator of the shedding mechanism of FIGS. 39 and 40, constructed as a pneumatic piston/cylinder unit.

FIGS. 39 to 42 show a further exemplary embodiment of a shedding mechanism 176 having thread control devices 14*g* which are designed according to the principle of the thread control devices 14*d* and 14*e* in FIGS. 24 to 27, but have modified actuators 178. For this purpose, the control elements 140 are arranged at the lower end in a guide 180 and connected via connecting elements 182 to the actuators 178, which are situated lower down. These then drive the control elements. In accordance with FIG. 41, such an actuator 178*a* can be constructed as a pneumatic piston/cylinder unit. A piston 184 connected to the connecting element 182 is pretensioned in the low position in the cylinder 186 by means of a return spring 188. Compressed air is supplied via the feed line 190 and the piston, and thus the control element, are raised. A further example of an actuator 178*b* is shown in FIG. 42. In this case, the actuator is constructed as an electromagnet and has in a housing 192 a coil 194 to which control current is applied via lines 196. A permanent magnet 198 is arranged displaceably in the coil 194 and connected to the control element 140 via the connecting element 182. The shedding mechanism is represented in open shed position in FIG. 39, and in closed shed position in FIG. 40.

Figure 43:
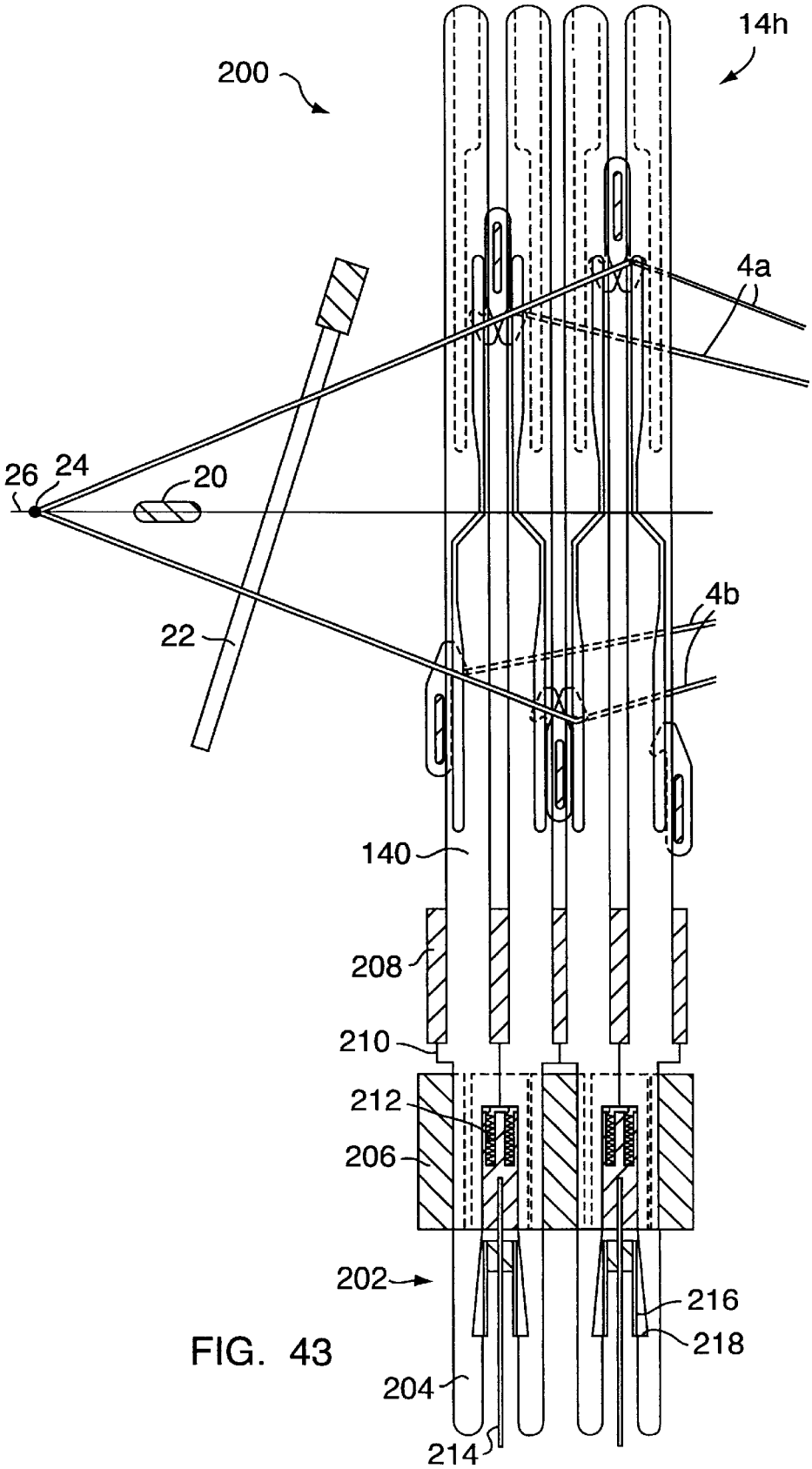
FIG. 43 shows a ninth shedding mechanism having thread control devices similar to FIGS. 24 to 27, having modified actuators.
Figure 44:
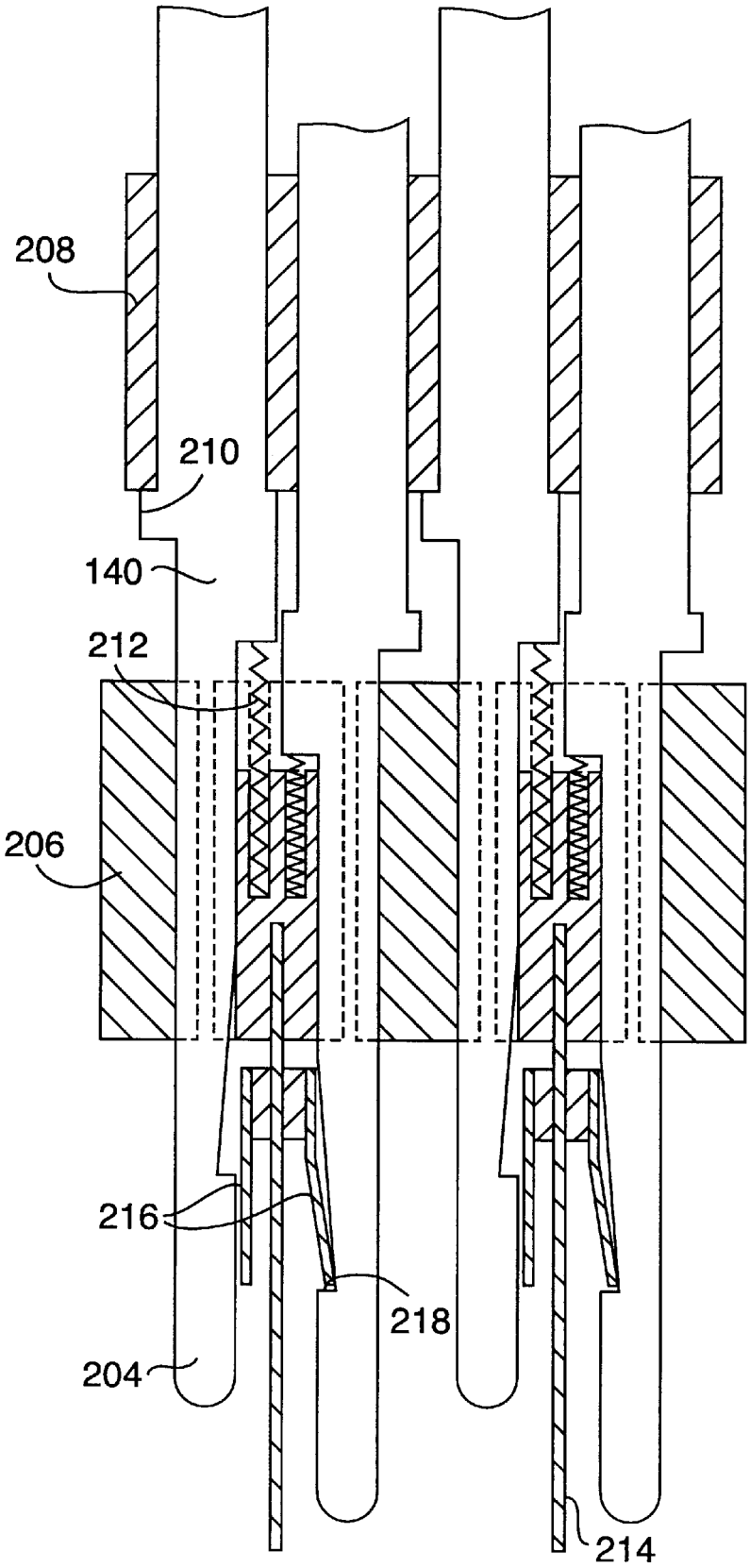
FIG. 44 shows the actuators of the shedding mechanism of FIG. 43, on a larger scale.

FIGS. 43 and 44 show a further shedding mechanism 200 having thread control devices 14*h* according to the principle of the thread control devices of FIGS. 24 to 27, but with further modified actuators 202. For this purpose, the control elements 140 each have at the lower end a guide element 204 which is guided moving up and down in a guide 206. Lease knives 208 which move up and down and in each case cooperate with a carrier part 210 on the control element 140 serve to drive the control elements. The biasing spring 212 in the guide 206 pretensions the control element 140, and thus the carrier part 210, against the lease knife 208, with the result that the control element 140 can follow the oscillating movement of the lease knife. Arranged on the underside of the guide 206 is a control plate 214 which carries piezoelectric switching devices 216 which, in the unswitched state, ensure the free movement of the guide element 204, and thus of the control element, and in the switched, that is to say activated state cooperate with a shoulder 218, with the result that the carrier part 210 and thus the control element 140 can no longer follow the lease knife 208. This retains the control element in one switching position, with the result that an associated warp thread 4 can no longer be passed on from one carrier 142 to the other carrier 144, and can thus no longer change from the low position into the high position, and vice versa.

Figure 45:
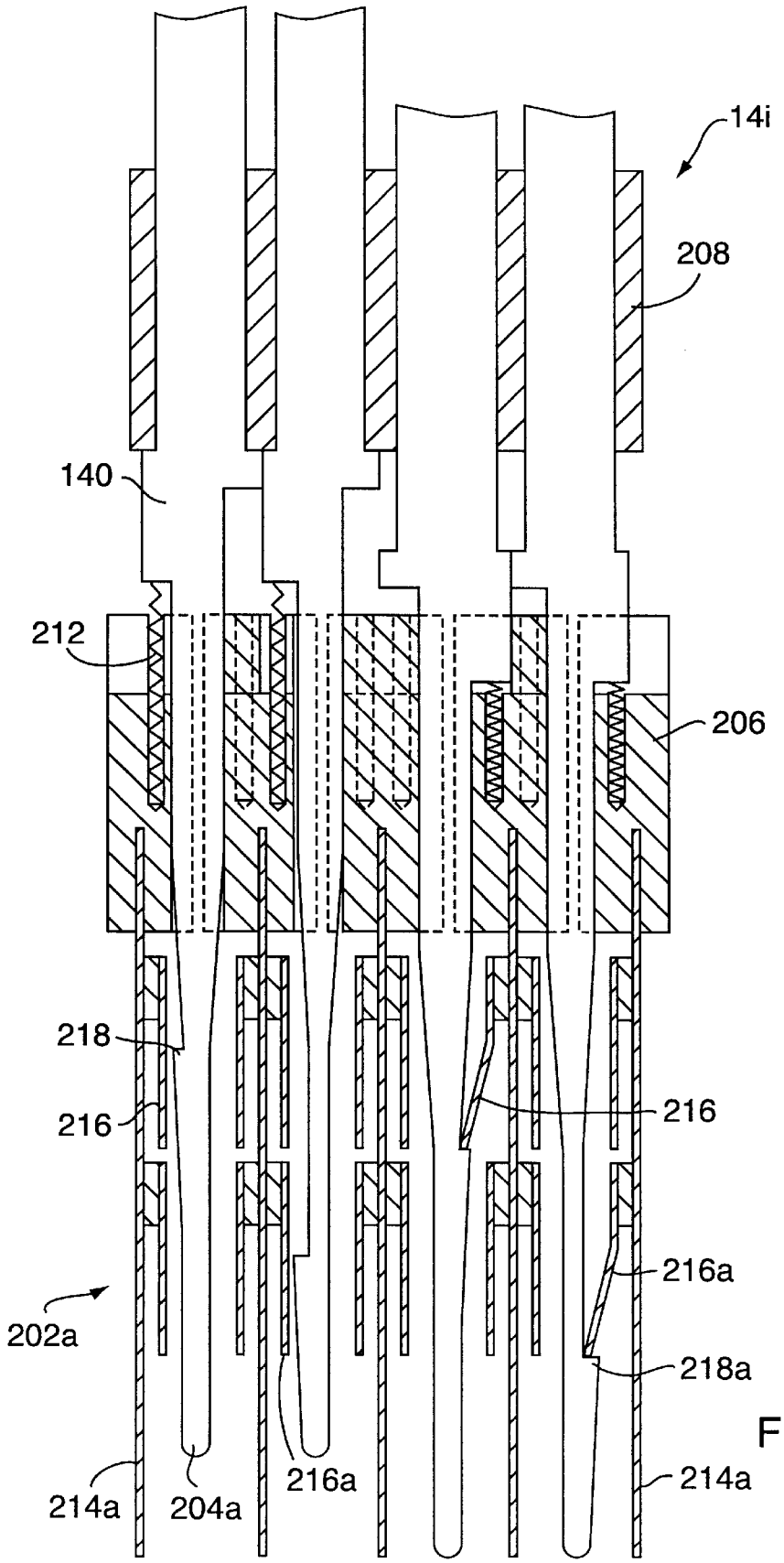
FIG. 45 shows the actuators of FIGS. 43 and 44 in a modified form in the section XXXXV—XXXXV of FIG. 47, in high position.
Figure 46:
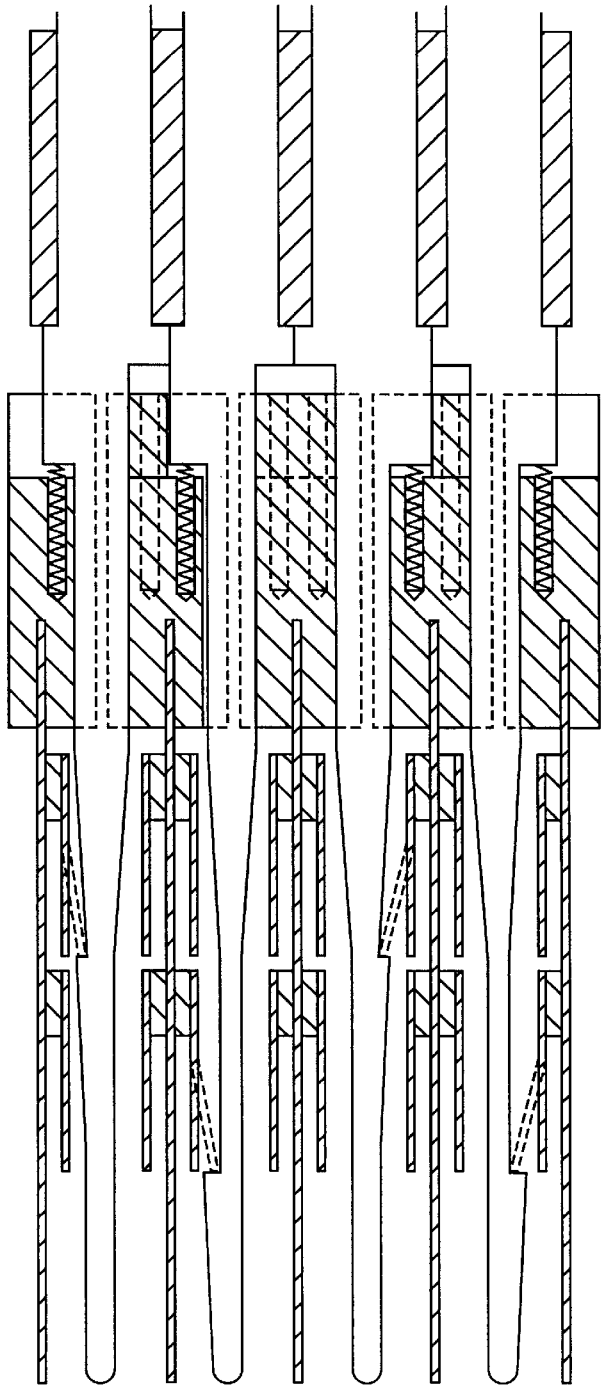
FIG. 46 shows the actuators of FIG. 45 in low position.
Figure 47:
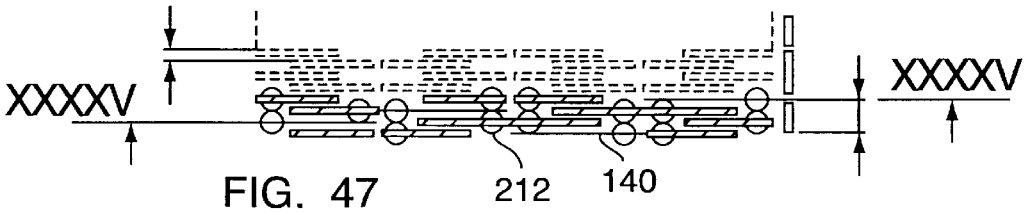
FIG. 47 shows the arrangement of the control elements of FIGS. 45 and 46, in plan view.

FIGS. 45 to 47 show a further embodiment of a thread control device 14*i*, which corresponds tog the thread control device 14*h* of FIGS. 43 and 44, although in this case the actuators 202*a* have control plates 214*a* with two rows, situated one under another, of switching devices 216, 216*a* which come into use alternately viewed in the longitudinal direction of the lease knife 208. Consequently, the guide elements 204*a* differ and have shoulders 218, 218*a* at appropriately offset positions. This permits a high package density of the thread control devices, and thus a high porter per centimeter. The lease knives are represented in high position in FIG. 45 and in low position in FIG. 46, individual switching devices 216, 216*a* being shown in the activated, that is to say deflected state in which they cooperate with the shoulders 218, 218*a* of the guide elements 204*a*.

Figure 48:
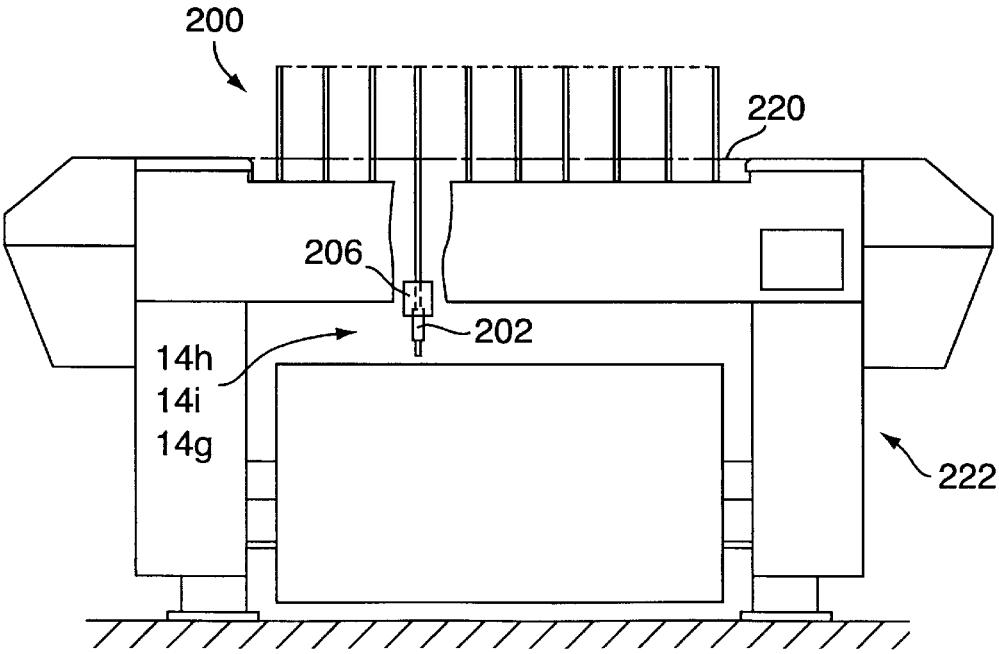
FIG. 48 shows a weaving machine having thread control devices in accordance with FIGS. 38 to 47 and direct drive of the control elements, in a view onto the front side.

The weaving machine represented in FIG. 48 includes a shedding mechanism 200 in accordance with FIGS. 39 to 43 having thread control devices 14*g*, 14*h*, 14*i* in accordance with FIGS. 39 to 47. In this case, the guide 206 with the actuators 202 is arranged below the weaving region 220 in the machine frame 222, with the result that the weaving region is freely accessible from the top side.

In the above exemplary embodiments, the thread control devices are shown in each case in conjunction with the control of warp threads for shed formation in a weaving machine. The thread control devices can, however, also serve to control other threads for other purposes, in particular for selecting weft threads which are either fed separately from the warp threads or, in particular, similarly to the warp threads.

What is claimed is:

1. Thread control device for optionally controlling an oscillating transverse movement of a thread of a weaving machine, having at least one lifting device, which can be driven in an oscillating fashion, having an at least one carrier for the thread, further having at least one control means which can be actuated by means of an actuator in order to bring the thread selectively into engagement with the at least one carrier, characterized in that the control means is arranged independently of the lifting device for the at least one carrier, the control means being adapted to move the thread selectively directly toward and away from the at least one carrier in an oscillating fashion by a switching amplitude (S).

2. Thread control device according to claim 1, wherein the control means has a control slot in order to move the thread by the switching amplitude (S).

3. Thread control device according to claim 2, wherein the control means has a slot which extends over the entire transverse movement of the thread.

4. Thread control device according to claim 2, wherein the control means is constructed as an elongated control element which is arranged to move to and fro in its longitudinal direction, the control slot extending in the control region at an angle to the displacement direction of the control element from one switching position of the thread into the other switching position of the thread.

5. Thread control device according to claim 4, wherein the control element moving to and fro in the longitudinal direction cooperates with a drive element, moving to and fro in the longitudinal direction of the thread control element, against which drive element the latter is pretensioned by means of a spring, the control element being provided with a retaining stop adaptable to cooperate in such a way that the control element follows the movement of the drive element in the event of an ineffective switching device, and is retained in a position in the event of an effective switching device.

6. Thread control device according to claim 4, wherein the control element (140) moving to and fro in the longitudinal direction is connected directly to the actuator.

7. Thread control device according to claim 4, wherein the control element moving to and fro in the longitudinal direction is pretensioned in one direction by means of a return spring, and is connected with the actuator via a connecting element.

8. Thread control device according to claim 1, wherein the at least one carrier includes a first carrier, and the control means is constructed like a lamella and at least partially covers the first carrier.

9. Thread control device according to claim 8, wherein the control means has at least two parallel lamellae which at least partially enclose the first carrier between them.

10. Thread control device according to claim 9, wherein the at least one carrier includes a second carrier, and the control means has at least one further lamella which at least partially encloses the second carrier.

11. Thread control device according to claim 1, wherein the at least one carrier is adaptable to permit its movement throughout any transverse movement of the thread.

12. Thread control device according to claim 1, wherein the at least one carrier includes a first carrier and a second carrier, the first carrier is adaptable to permit its movement along a first segment of the transverse movement of the thread, and there is present for the remainder of the transverse movement of the thread the second carrier which is oppositely directed with respect to the first carrier, the control means being effective for the selective transfer of threads at a crossing point of the first and second carriers.

13. Thread control device according to claim 1, wherein at least one carrier has a carrier hook for driving the thread in a shaped closure fashion in one direction of movement and returning the thread in a forced closure fashion in the other direction of movement.

14. Thread control device account to claim 10, wherein the carrier hook is arranged at the end of a spring tongue.

15. Thread control device according to claim 13 wherein the carrier hook has a thread rejector at a free end.

16. The thread control device of claim 13, wherein the carrier hook is operatively associated with one or more run-on guides.

17. Thread control device according to claim 1, wherein the at least one carrier has a carrier hook which includes a double hook shaped closure adapted to capture the thread in both directions of movement.

18. Thread control device according to claim 1, wherein the carrier has two carrier hooks which point away from one another and to which in each case a control means for laying in a thread is assigned.

19. Device according to claim 1 wherein the actuator includes a piezoelectric switching device.

20. Device according to claim 1 wherein the actuator is constructed as a piston/cylinder unit for actuation by a fluid.

21. Thread control device according to claim 1, wherein the actuator is constructed as an electromagnet.

22. Thread control device according to claim 1, wherein the actuator can be activated in one drive direction and can be returned in the other direction by means of a spring.

23. Thread control device according to claim 1, wherein the control means is constructed as a control element adapted to be pivoted by the switching amplitude (S) and is arranged on a support rail.

24. Thread control device according to claim 23, wherein control elements arranged in pairs are mounted pivotably on a common support which is fastened to the support rail and has a spring arm which pretensions the control elements against the actuator.

25. Thread control device according to claim 23, wherein the control element mounted pivotably on a support rail has a control stop and a biasing spring which pretensions the control stop against a switching device which releases the control stop in the switching state and brings the control element into engagement with an actuator, the actuator being capable of oscillating.

26. Thread contral device according to claim 1, wherein the at least one carrier is arranged on a lifting rail of the lifting device.

27. Thread control device according to claim 26, wherein control elements combined into groups are adapted to be driven in each case by a common actuator.

28. Thread control device according to claim 1, wherein it is adapted to be a component of shedding mechanism of a weaving machine, a multiplicity of the thread control devices being present for controlling the warp threads of the weaving machine.

* * * * *

UNITED STATES PATENT AND TRADEMARK OFFICE

CERTIFICATE OF CORRECTION

PATENT NO. : 6,328,076 B1
DATED : December 11, 2001
INVENTOR(S) : Francisco Speich It is certified that error appears in the above-identified patent and that said Letters Patent is hereby corrected as shown below:

Title page,
After item [22], please change the data PCT Filed: from "July 8, 1998" to -- August 7, 1998 --.

Signed and Sealed this

Thirteenth Day of August, 2002

*Attest:*

*Attesting Officer*

JAMES E. ROGAN
*Director of the United States Patent and Trademark Office*